US010781075B2

(12) United States Patent
Witczak et al.

(10) Patent No.: US 10,781,075 B2
(45) Date of Patent: Sep. 22, 2020

(54) EMERGENCY SAFETY ACTUATOR FOR AN ELEVATOR

(71) Applicant: OTIS ELEVATOR COMPANY, Farmington, CT (US)

(72) Inventors: Tadeusz Witczak, Bethel, CT (US); Daryl J. Marvin, Farmington, CT (US); Zbigniew Piech, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 538 days.

(21) Appl. No.: 15/025,664

(22) PCT Filed: Sep. 30, 2013

(86) PCT No.: PCT/US2013/062612
§ 371 (c)(1),
(2) Date: Mar. 29, 2016

(87) PCT Pub. No.: WO2015/047391
PCT Pub. Date: Apr. 2, 2015

(65) Prior Publication Data

US 2016/0236904 A1 Aug. 18, 2016

(51) Int. Cl.
*B66B 5/18* (2006.01)
*B66B 5/22* (2006.01)
*B66B 9/00* (2006.01)

(52) U.S. Cl.
CPC ..... *B66B 5/18* (2013.01); *B66B 5/22* (2013.01); *B66B 9/00* (2013.01)

(58) Field of Classification Search
CPC ..... B66B 5/18; B66B 5/22; B66B 5/16
See application file for complete search history.

(56) References Cited

U.S. PATENT DOCUMENTS 5,791,442 A * 8/1998 Arnold ..... H01F 5/00 188/138
6,161,653 A 12/2000 Skalski et al.
(Continued)

FOREIGN PATENT DOCUMENTS

CN 101287670 10/2008
JP 2004338901 A 12/2004
(Continued)

OTHER PUBLICATIONS

European Search Report for application EP 13894708.0, dated Aug. 30, 2017, 9 pages.
(Continued)

*Primary Examiner* — Diem M Tran
(74) *Attorney, Agent, or Firm* — Cantor Colburn LLP

(57) ABSTRACT

A device for a friction force provider for an emergency safety actuator for an elevator is disclosed. The friction force provider may include a housing having a first end and an opposing second end, where the first end may define an opening. The friction force provider may further include a primary magnet positioned within the housing and configured to move between an armed position and a working position. The primary magnet may be configured to create a force on a rail of an elevator system in the working position and be held within the housing in the armed position.

17 Claims, 4 Drawing Sheets

(56) References Cited

U.S. PATENT DOCUMENTS

| | | | | |
|---|---|---|---|---|
| 7,549,513 | B2 * | 6/2009 | Chida | B66B 5/0031 187/248 |
| 2005/0087407 | A1 | 4/2005 | Fischer | |
| 2007/0056806 | A1 | 3/2007 | Okamoto et al. | |
| 2010/0252379 | A1 | 10/2010 | Piech et al. | |
| 2015/0259175 | A1 * | 9/2015 | West | B66B 5/18 187/359 |

FOREIGN PATENT DOCUMENTS

| | | | |
|---|---|---|---|
| JP | 2008254837 | A | 10/2008 |
| WO | 2014077811 | A1 | 5/2014 |

OTHER PUBLICATIONS

International Search Report for application PCT/US2013/062612, dated May 29, 2014, 4 pages.
Written Opinion for application PCT/US2013/062612, dated May 29, 2014, 7 pages.
Chinese Second Office Action and Search Report for application CN 201380080094.1, dated Apr. 28, 2018, 4 pages.

* cited by examiner

EMERGENCY SAFETY ACTUATOR FOR AN ELEVATOR

FIELD OF THE DISCLOSURE

The present disclosure generally relates to elevator braking systems and, more specifically, to magnetic triggering mechanisms and friction force providers for elevators.

BACKGROUND OF THE DISCLOSURE

Elevator systems are widely used in a variety of applications for transporting passengers from point to another. Typical contemporary elevator systems often include an emergency braking system that reduce speed or altogether halt the progression of the elevator car if the elevator system loses power. Conventional emergency braking systems are large and generally include a large number of mechanical parts, which not only decreases the load carrying capacity of the elevator car, it increases the size of the elevator shaft to accommodate the braking system, and increases construction and maintenance costs of the elevator system.

In conventional emergency braking systems, a governor is used to activate and maintain a ready state of the emergency braking system. The governor, which is usually situated at the top of an elevator hoistway, monitors the speed of the elevator as it travels through the hoistway and, activates the emergency braking system if the elevator car begins moving too quickly. This in turn requires a connection between the governor and the elevator car of the elevator system. The connection adds complexity to the elevator car and the hoistway, thereby further increasing cost and maintenance time.

Therefore, an improved emergency braking system with a reduced size, complexity, and cost compared to prior art emergency braking systems is desired. It will also be beneficial if the improved emergency braking system could maintain an indefinite ready state and an engaged state.

SUMMARY OF THE DISCLOSURE

In accordance with one aspect of the disclosure, a device for a friction force provider for an emergency safety actuator for an elevator system is disclosed. The friction force provider may include a housing having a first end and an opposing second end, where the first end may define an opening. The friction force provider may further include a primary magnet positioned within the housing and configured to move between an armed position and a working position. The primary magnet may be configured to create a force on a rail of the elevator system in the working position and be held within the housing in the armed position.

In a refinement, the friction force provider may further include a triggering mechanism having a holding plate formed of a magnetically sensitive material mounted within the housing. The friction force provider may yet further include an electro-magnetic coil positioned within the housing and associated with the primary magnet.

In a further refinement, the electro-magnetic coil may be mounted in a stationary position within the housing.

In another further refinement, the electro-magnetic coil may be mounted with the primary magnet such that the electro-magnetic coil may move with the primary magnet.

In yet a further refinement, the friction force provider may further include a secondary magnet positioned within the housing and may be mounted with the primary magnet and the electro-magnetic coil such that the secondary magnet may move therewith. The primary magnet and the secondary magnet may be positioned on opposing ends of the electromagnetic coil.

In another refinement, the friction force provider may further include a spring positioned within the housing to bias the primary magnet towards the first end. The friction force provider may also include a latch positioned to retain the primary magnet within the housing.

In a further refinement, the friction force provider may be configured to operate with a ropeless elevator.

In yet another refinement, the friction force provider may include a guard mounted with the primary magnet, the guard may be configured to move with the primary magnet. The guard may have a trapezoidal shaped portion that may extend through the opening of the housing while the primary magnet is in the working position.

In yet another embodiment, the friction force provider may further include a braking pad mounted with the primary magnet such that at least in the working position the braking pad may extend through the opening of the housing.

In accordance with another aspect of the present disclosure, an elevator system is disclosed. The elevator system may include a hoistway, a car disposed within the hoistway, a counter weight disposed within the hoistway, a support structure operatively associated with the car and counter weight, a rail associated with the car and an emergency safety actuator operatively associated with the car and rail and having a friction force provider configured to apply a force to the rail. The emergency safety actuator may have a triggering mechanism associated with the friction force provider to activate the actuator.

In a refinement, the triggering mechanism may be integral with the friction force provider and the friction force provider may include a housing having a first end and an opposing second end, the first end defining an opening. The friction force provider may also include a primary magnet positioned within the housing, the primary magnet configured to move between an armed position and a working position, an electromagnetic coil associated with the primary magnet and a holding plate mounted within the housing.

In a further refinement, the electro-magnetic coil may be mounted with the primary magnet such that the electromagnetic coil may move with the primary magnet.

In yet another refinement, the friction force provider may further include a secondary magnet mounted with the primary magnet and electromagnetic coil such that the secondary magnet moves with both, and is positioned such that the primary magnet and secondary magnets are positioned on opposing ends of the electromagnetic coil.

In another further refinement, the electro-magnetic coil may be mounted in a stationary position within the housing.

In another refinement, the triggering mechanism may be external to the friction force provider, and the friction force provider may include a housing having a first end and an opposing second end, the first end defining an opening, a spring positioned within the housing at the second end and configured to expand towards the first end and a latch configured to retain the spring within the housing at the second end. The triggering mechanism may include a trigger housing having a first end and an opposing second end, the first end of the trigger housing defining an opening, a holding plate mounted within the trigger housing, an electromagnetic coil mounted within the trigger housing, a trigger magnet moveably positioned within the trigger housing, the trigger magnet having an armed position and a working position and a pin mounted with the trigger magnet such that in the working position the pin may move and release the latch of the friction force provider.

In a further refinement, the friction force provider may further include a primary magnet positioned within the housing and associated with the spring such that in the working position the primary magnet may be directed towards the first end of the housing to contact the rail.

In accordance with yet another aspect of the present disclosure, a method of activating a magnetic friction force provider of an elevator emergency safety actuator is disclosed. The method may include retaining a primary magnet within a housing of the friction force provider in an armed position, releasing the primary magnet from the armed position by transmitting an electrical signal through an electro-magnetic coil of a triggering mechanism, extending the primary magnet from the armed position to a working position, and retaining the primary magnet in the working position.

In a refinement the method may further include retaining the primary magnet within the housing of the friction force provider in the armed position through a magnetic attraction from the primary magnet to a holding plate, activating the triggering mechanism to neutralize the magnetic attraction between the primary magnet and the holding pate to release the primary magnet from the armed position, extending the primary magnet through an opening in the housing of the friction force provider to the working position through magnetic attraction of the primary magnet to the rail and retaining the primary magnet in the working position through a magnetic attraction from the primary magnet to the rail.

In another refinement, the method may further include retaining the primary magnet within the housing of the friction force provider in the armed position with a latch and biasing the primary magnet towards a working position with a spring, retaining a trigger magnet in an armed position within a trigger housing of the triggering mechanism by a magnetic attraction from the trigger magnet to the holding plate, activating the triggering mechanism by transmitting a signal through the electro-magnetic coil to neutralize the magnetic attraction from the trigger magnet to the holding plate, moving the trigger magnet within a trigger housing of the triggering mechanism through magnetic attraction, and moving the pin with the movement of the trigger magnet, releasing the latch with the pin, extending the primary magnet through an opening in the housing of the friction force provider with the spring and retaining the primary magnet in the working position and in contact with the rail through a magnetic attraction from the primary magnet to the rail.

In yet another refinement, the method may further include retracting the primary magnet from the working position to the armed position by transmitting a second electrical signal through the electro-magnetic coil.

These and other aspects and features of the present disclosure will be better understood in light of the following detailed description when read in light of the accompanying drawings.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION

Figure 1:
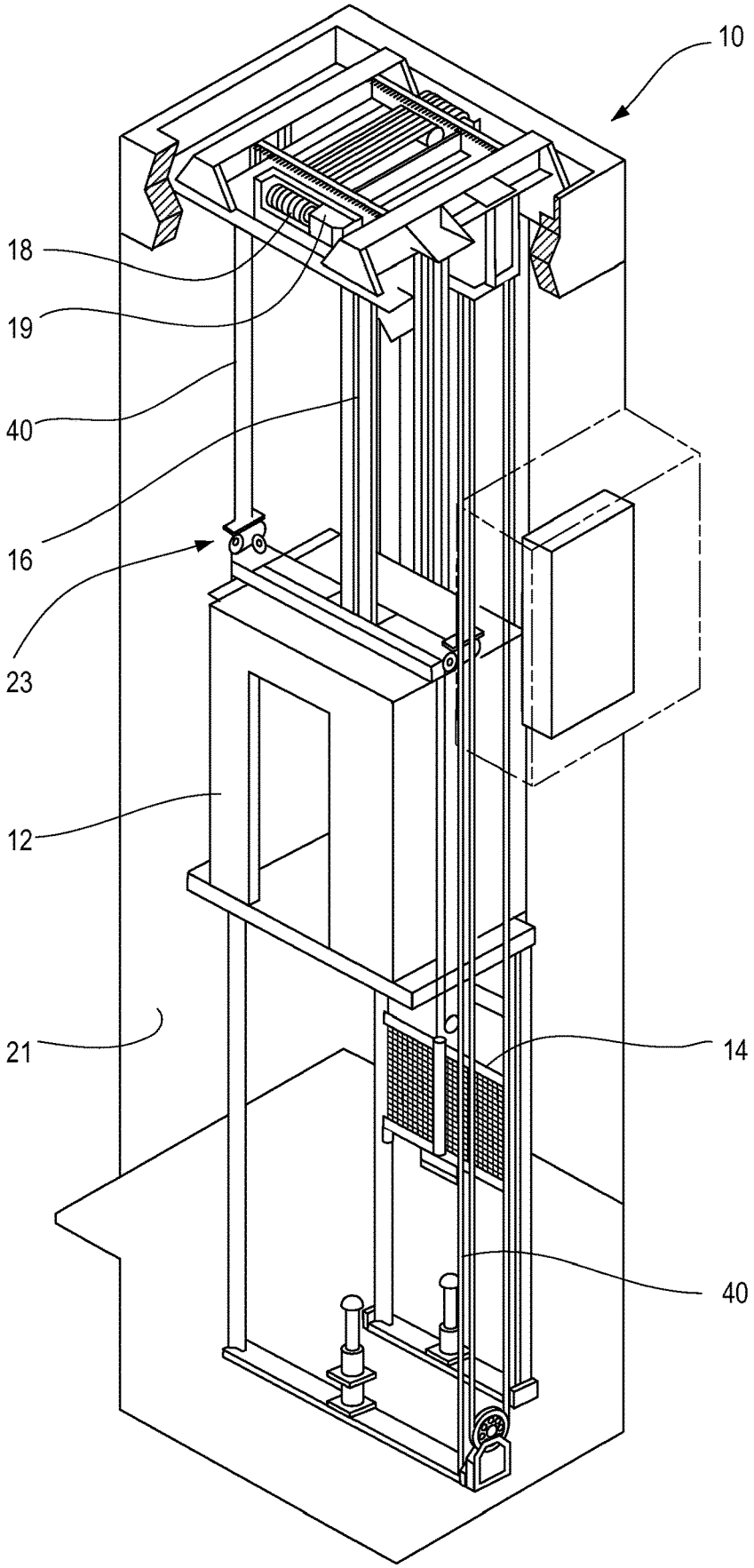
FIG. 1 is a perspective view of an exemplary elevator system, constructed in accordance with an aspect of the present disclosure.

Referring now to FIG. 1, an exemplary elevator system 10 is illustrated. It is to be understood that the elevator system shown in FIG. 1 is for illustrative purposes only and to present various elements of a general elevator system. As illustrated, the elevator system 10 may include a car 12 coupled to a counter weight 14 via a supporting structure 16. The support structure 16 may extend over a traction sheave 18 and may be driven by a machine 19 to move the car 12 and the counter weight 14 through a hoistway 21. A set of rails 40 positioned within the hoistway 21 may guide the car 12 and counter weight 14 as both move through the hoistway. The elevator system 10 may further include an electrical safety system (ESS) 23 positioned on the car 12 proximate the rails 40.

Figure 2:
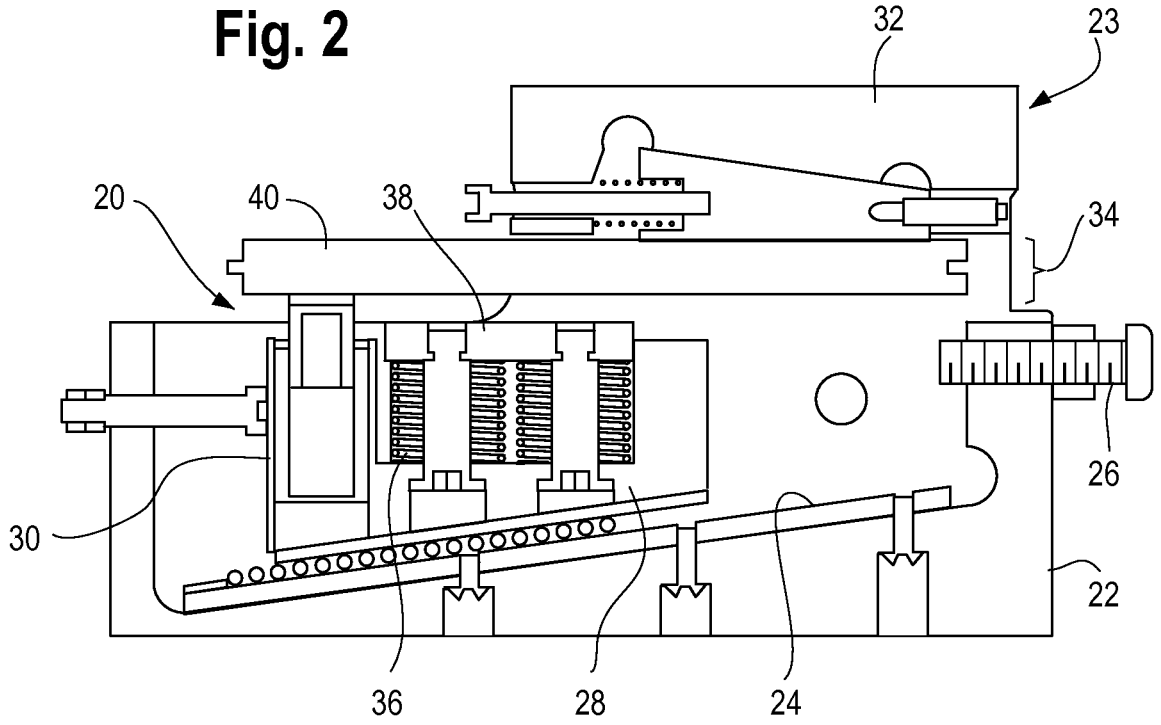
FIG. 2 is a cross-sectional view of an electrical safety system for use in the elevator system of FIG. 1, the electrical safety system constructed in accordance with an aspect of the present disclosure.

Turning now to FIG. 2, a cross-section of an exemplary one of the ESS 23 is shown, in accordance with at least some embodiments of the present disclosure. As shown, the ESS 23 may include a body 22 defining a sloped slide path 24, a bolt 26, a wedge 28 positioned within the sloped slide path 24, an emergency safety actuator (ESA) 20 having a friction force provider (FFP) 30 mounted on the wedge 28, and a secondary block 32 spaced apart from the body 22 and defining a passage 34 therebetween. In some embodiments, the body 22 and secondary block 32 may be provided as a unitary piece, while in other embodiments, the body and the block may be provided as separate pieces held in a stationary relationship to each other, such as by a bolt or the like.

The wedge 28 may include a spring 36 and a braking pad 38 mounted to the spring and facing the passage 34. Multiple springs 36 or sets of springs 36 may also be utilized with the wedge 28. The ESS 23 may also include an optical speed/acceleration sensor that monitors the speed of the car 12 in the hoistway 21 and transmits signals to activate the ESA 20 during an emergency, such as loss of power or excessive speed. This sensor eliminates the need for a governor, and equipment linking the governor and the car 12, thereby greatly simplifying the elevator system 10. A ropeless elevator is one exemplary elevator that may utilize such an ESS 23. Another exemplary elevator may be a low speed elevator, where the sensors may be mounted on the counterweight 14.

As the car 12 ascends and descends, the ESS 23 may travel along the rail 40, where the rail 40 may be positioned in the passage 34. Upon power loss, run away, free fall, or a similar emergency, a signal may be transmitted from a source, such as the optical speed sensor, to the ESA 20. The friction force provider 30 may react to this signal by extending to contact the rail 40 and creating a force that may be used to create a friction force required to move the wedge 28 with the rail 40 along the sloped slide path 24 until the wedge 28 encounters the bolt 26. If the car 12 is moving when the friction force provider 30 is active, the wedge 28 may move along the sloped slide path 24. As the wedge 28 moves, the braking pad 38 may contact the rail 40 and compress the spring 36, which may facilitate a smooth transition from free motion to braking.

This friction between the braking pad 38 and the rail 40 may reduce the speed of the elevator and eventually bring the car 12 to a stationary position relative to the rail 40. If the power were to fail while the car 12 is stationary, the friction force provider 30 may extend, but the wedge 28 may not move. This ensures that the brakes would be engaged in an emergency, but would not cause unnecessary wear on the braking pad 38 and the rail 40.

Figure 3:
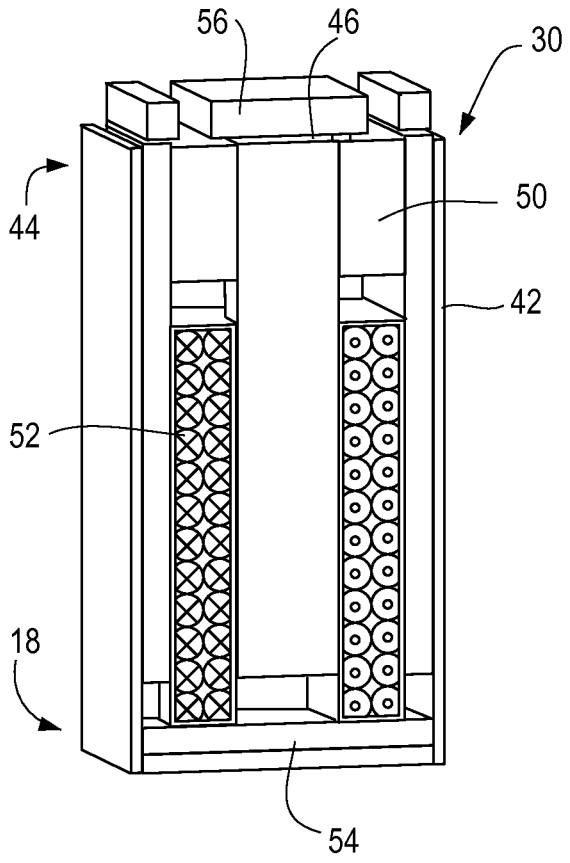
FIG. 3 is a perspective view of a friction force provider for use with the electrical safety system of FIG. 2, the friction force provider constructed in accordance with an aspect of the present disclosure and detailing a transitional position and a stationary coil.

As can be seen in FIG. 3, the friction force provider 30 may include a housing 42 having a first end 44 defining an opening 46 and a second end 48, opposite the first end 44. The friction force provider 30 may further include a primary magnet 50, provided as a permanent magnet. For the purposes of the present disclosure, a permanent magnet is any magnet formed from a material that has a natural quality of creating a constant magnetic field. This is opposed to an electro-magnet that can create either a constant or a varying magnetic field, but only when supplied with an electrical current or signal. The primary magnet 50 may be moveably mounted within the housing 42 to have at least an armed position and a working position. In the armed position, the primary magnet 50 may be retained in a recessed position within the friction force provider 30, and in the working position, the primary magnet may be positioned such that a magnetic flux of the primary magnet 50 is closed through the rail 40.

Friction Force Provider with Integrated Triggering Mechanism

Figure 4:
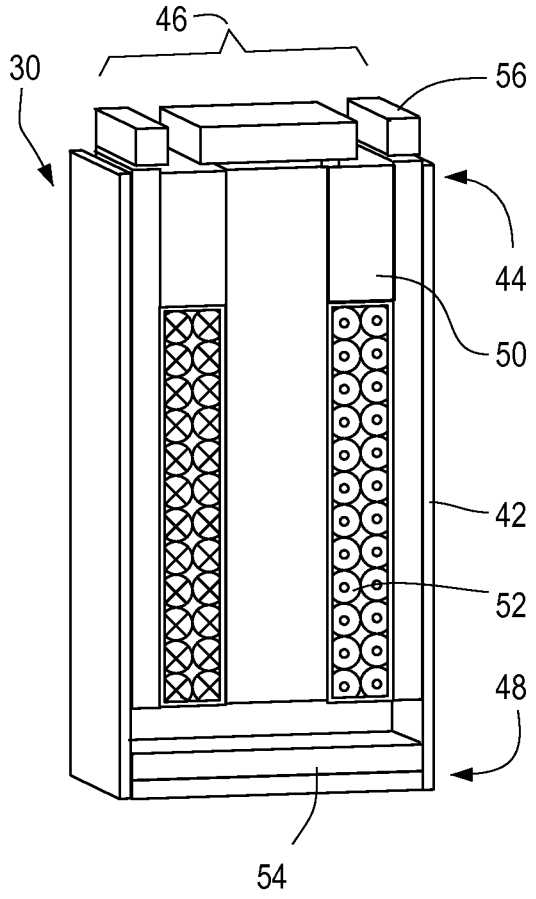
FIG. 4 is a perspective view of the friction force provider built in accordance with an aspect of the present disclosure and detailing a transitional position and a moveable coil.
Figure 5:
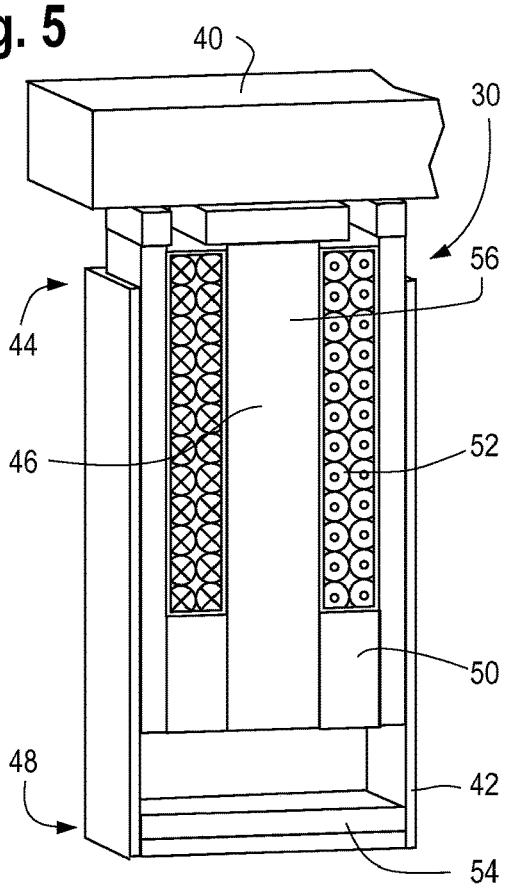
FIG. 5 is a perspective view of the friction force provider built in accordance with an aspect of the present disclosure and detailing a working position.

In the following embodiments, the ESA 20 may further include a triggering mechanism 51 (see FIG. 11) that may be provided integral with the friction force provider 30 and may include an electro-magnetic coil 52 mounted within the housing 42 of the friction force provider. The coil 52 may be provided as a stationary component or may be moveably mounted. As illustrated in FIG. 3, the coil 52 may be mounted in a stationary position within the housing 42 at the second end 48. Alternatively, the coil 52 may be moveably mounted with the primary magnet 50, as illustrated in FIGS. 4 and 5. In each of these cases, a holding plate 54 may also be included in the triggering mechanism and mounted in a stationary position. The holding plate 54 may be formed of any magnetically sensitive material, such as steel. In the armed position, the magnetic flux of the primary magnet 50 may be closed through the holding plate 54.

The positioning of the primary magnet 50 relative to the holding plate 54 and coil 52 may help to manage the holding force in both the armed and working positions. For example, in the embodiments illustrated in FIGS. 3 and 4, the coil 52 is positioned between the holding plate 54 and primary magnet 50. This positioning may create a stronger bond with the rail 40 when in the working position, while having a weaker bond with the holding plate 54 when in the armed position. As an alternate embodiment to those presented in FIGS. 3 and 4, the primary magnet 50 may be moveably mounted in the housing 42 between the coil 52 and the holding plate 54, as in FIG. 5. This positioning may create a stronger bond between the primary magnet 50 and the holding plate 54 in the armed position, as opposed to the bond between the primary magnet 50 and rail 40 in the working position of this same embodiment.

Figure 6:
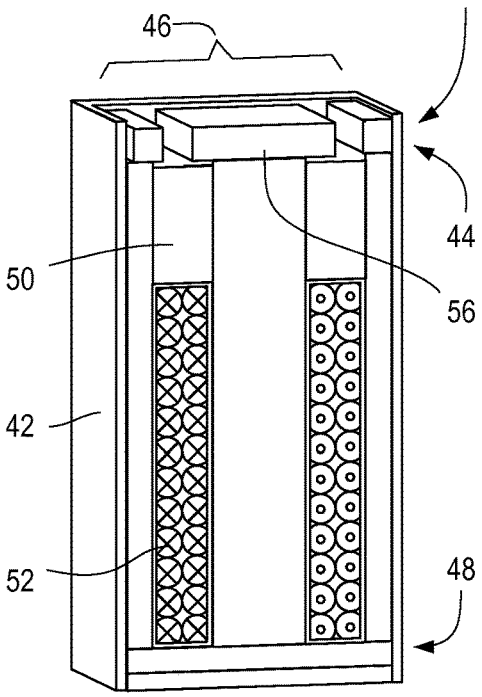
FIG. 6 is a perspective view of the friction force provider built in accordance with an aspect of the present disclosure and detailing an armed position.

In the armed position of FIG. 6 for one embodiment, the primary magnet 50 may be held within the housing 42 of the FFP 30 in a recessed position. In this position the magnetic flux from the primary magnet 50 may be closed through the holding plate 54, and thereby the primary magnet 50, and coil 52 in some embodiments, may be held in this position. As can be seen, the armed position may be held indefinitely without the use of electricity.

Figure 7:
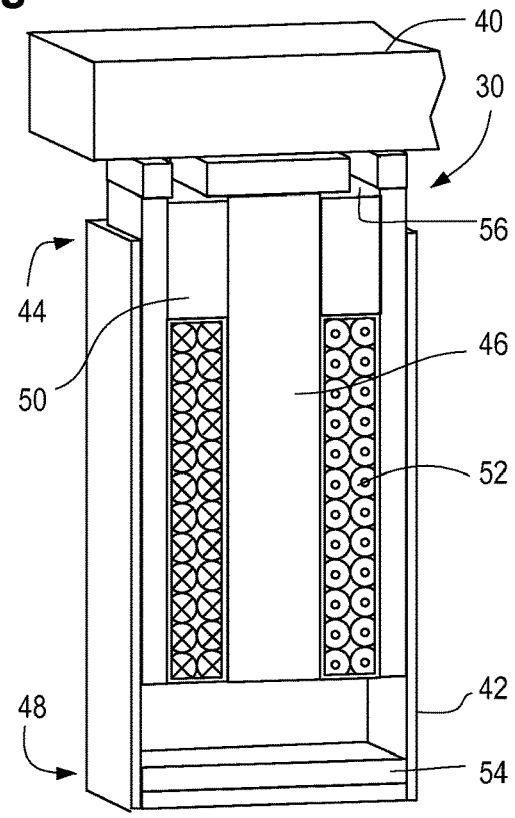
FIG. 7 is a perspective view of the friction force provider built in accordance with an aspect of the present disclosure and detailing a working position.

An electric signal may be transmitted through the coil 52 to initiate a transition of the primary magnet 50 from the armed position to the working position. This electric signal may originate from a great many apparatuses, such as the optical speed/acceleration sensor discussed above. The signal may cause the coil 52 to create a magnetic field of its own. A signal may be transmitted through the coil 52 in two directions: one direction may create a magnetic field that opposes the field of the primary magnet 50 in the armed position, and the other direction may create a magnetic field that compliments the field of the primary magnet 50 in the armed position. To initiate a transition from the armed position to the working position, an opposing magnetic field may be created. By doing so, the magnetic bond between the primary magnet 50 and holding plate 54 may be interrupted, allowing the primary magnet 50 to move away from the holding plate 54 through a magnetic attraction to the rail 40. This attraction may pull the primary magnet 50 towards the rail 40, where the magnetic flux of the primary magnet 50 may then be closed through the rail 40, thus holding the primary magnet in the working position, as illustrated in FIGS. 5 and 7.

Once in the working position, the primary magnet 50 may not release until the friction force provider 30 is reset. This may be accomplished through mechanical or electrical means. To reset the friction force provider 30 through electrical means, a second, reverse, electrical signal may be transmitted through the coil 52. In the embodiment of FIG. 3 where the coil 52 is stationary within the housing 42, the second signal may create a magnetic field that attracts the primary magnet 50 away from the rail and back into the armed position, where the primary magnet 50 is retained through its own magnetic field. In the embodiments of FIGS. 4 and 5 where the coil 52 is moveably mounted with the primary magnet 50, the second signal may create a magnetic field that interrupts the magnetic attraction between the primary magnet 50 and the rail 40 and redirects the magnetic field towards the holding plate 54. This may pull the combined primary magnet 50 and coil 52 away from the rail 40 towards the holding plate 54 and into the armed position, where the combined primary magnet 50 and coil 52 may be retained through the magnetic field produced by the primary magnet 50 alone, and the field from the coil 52 is no longer needed. In both of these embodiments, the magnetic attraction between the coil 52 and the holding plate 54 created by transmitting the second signal through the coil 52 may be strong enough to redirect the field from the primary magnet 50 directed towards the rail 40 to overcome the latter attraction.

Figure 8:
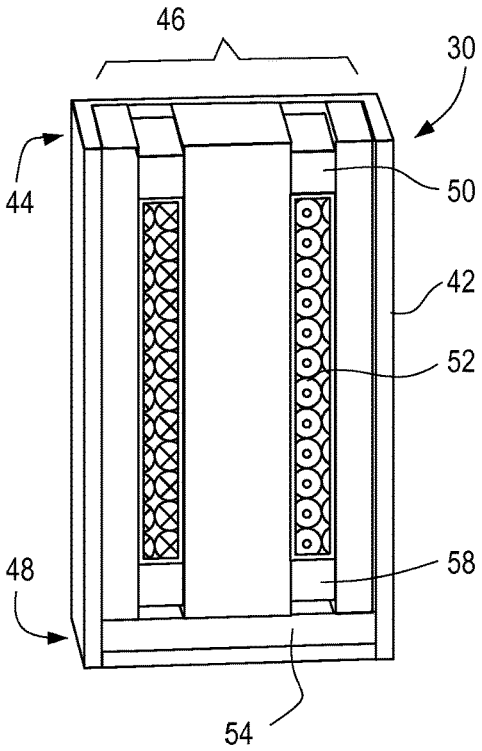
FIG. 8 is a perspective view of the friction force provider built in accordance with an aspect of the present disclosure and detailing a secondary magnet.

As illustrated in FIGS. 3-7, a braking pad 56 may be provided moveably mounted with the primary magnet 50 at the first end 44 of the friction force provider 30. Specifically, the braking pad 56 may be positioned such that in the working position, the braking pad 56 is positioned in contact with the rail 40. The braking pad 56 may cushion the impact between the friction force provider 30 and rail 40 when the primary magnet 50 transitions to the working position and prevents any direct contact between the rail 40 and primary magnet 50 or the rail 40 and the coil 52 while the primary magnet 50 is in the working position. This increases the life of the primary magnet 50, the friction force provider 30, and the rail 40 and increases friction coefficient which allows for a reduction in the required force, further reducing the size requirements for the friction force provider 30. The braking pad 56 may be formed of a magnetically sensitive material to convey the magnetic field from the primary magnet 50 to the rail 40, but other materials are also possible. As illustrated in FIG. 8, the friction force provider 30 may also be provided without a braking pad 56 to reduce weight and part count of the friction force provider.

A secondary magnet 58 may also be provided moveably mounted with the primary magnet 50 and coil 52 as illustrated in FIG. 8. More specifically, the secondary magnet 58 may be provided within the housing 42 such that a permanent magnet is positioned at both ends of the coil 52. This configuration assists in the resetting procedure by reducing the magnetic field strength, specifically of the field created by the coil 52, needed to separate the primary magnet 50 from the rail 40.

Figure 9:
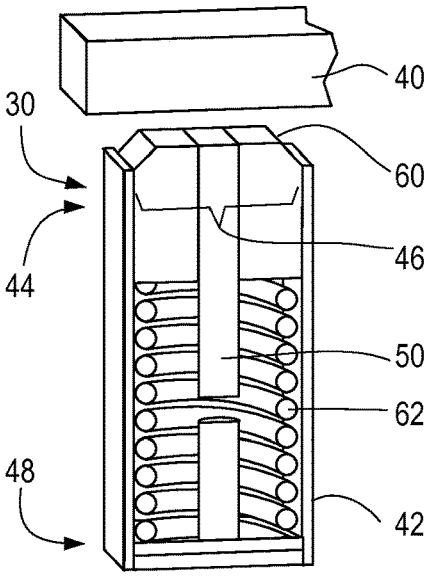
FIG. 9 is a perspective view of the friction force provider built in accordance with an aspect of the present disclosure and detailing an armed position and a guard piece.

A guard piece 60 may also be provided around the primary magnet 50 as illustrated in FIG. 9. This guard 60 may also be moveably mounted with the primary magnet 50 to be retracted and extended with the primary magnet 50 or a stationary and integral element of the housing 42 of the friction force provider 30. When the primary magnet 50 is extended, the guard 60 may contact the rail 40 to prevent the primary magnet 50 from impacting the rail 40. To assist in smoothly transitioning across the rail 40, the guard 60 may have a trapezoidal shaped portion that extends through the opening 46 at least at the working position. This shape allows the guard 60 and the friction force provider 30 to translate across and bumps or other features of the rail 40 without creating unnecessary strain on the friction force provider. The guard 60 may be formed of a magnetically sensitive material to convey the magnetic field from the primary magnet 50 to the rail 40. However, other materials are also possible.

Friction Force Provider with External Triggering Mechanism

Figure 10:
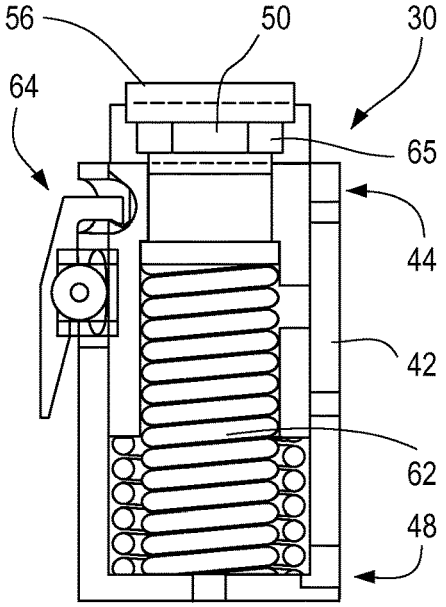
FIG. 10 is a cross-sectional view of the friction force provider built in accordance with an aspect of the present disclosure and detailing a spring force provider with a magnet.

In the following embodiments, the ESA 20 further includes a triggering mechanism 51 that is provided as a separate component from the FFP 30. As illustrated in FIGS. 9 and 10, the FFP 30 of this embodiment includes a spring 62 positioned within the housing 42 at the second end 48. The spring 62 works to bias the primary magnet 50 towards the opening 46 at the first end 44 of the housing 42. To counter the spring 62 and retain the primary magnet 50 in the housing 42 in the armed position, a latch 64 is provided. This latch 64 may take many forms, and should not be considered as limited to just the form illustrated in the presented figures. When triggered, the latch 64 releases the primary magnet 50, allowing the spring 62 to move the primary magnet 50 to a position where the magnetic flux of the primary magnet 50 can be closed through the rail 40.

A filler 65 may be mounted with the primary magnet 50, as illustrated in FIG. 10. This filler may be made of a magnetically sensitive material, such as steel for example, but other materials are also possible. This filler 65 may occupy any intervening space surrounding the primary magnet 50 within the housing 42.

Figure 11:
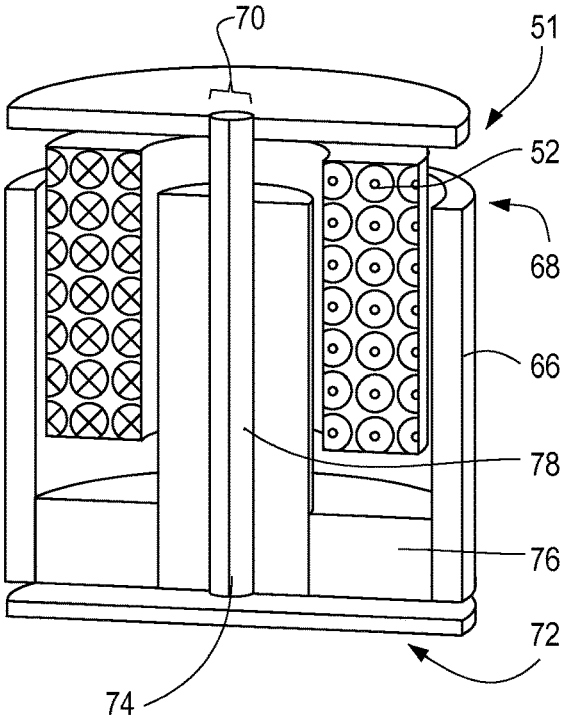
FIG. 11 is a perspective view of an external triggering mechanism built in accordance with an aspect of the present disclosure and detailing an armed position

As can be seen in FIG. 11, the triggering mechanism 51 of this embodiment may include a trigger housing 66 having a first end 68 defining an opening 70 and an opposed second end 72. A holding plate 54 is mounted in a stationary position within the trigger housing 66. An electro-magnetic coil 52 and a trigger magnet 76 may also be mounted within the trigger housing 66. In the embodiment illustrated in FIG. 11, the coil 52 is mounted in a stationary position at the first end 68, the holding plate 54 is mounted in a stationary position at the second end 72, and the trigger magnet 76 is moveably mounted between the coil 52 and holding plate 54, having an armed position and a working position. The illustrated configuration is only one possible configuration, and others also exist. For example, configurations similar to those of the FFP 30 presented above, where the coil 52 separates the primary magnet 50 and holding plate 54 are also possible. The coil 52 may define a passage 74 in communication with the opening 70 of the trigger housing 66. A pin 78 is also moveably mounted with the trigger magnet 76. In the illustrated embodiment the pin 78 is positioned within the trigger housing 66 and through the passage 74 and in the working position, the pin 78 moves through the opening 70 to release the latch 64 of the FFP 30. In other embodiments, the pin 78 may also extend beyond the housing 66 or be held outside of the housing 66 altogether In the armed position of the illustrated embodiment, the trigger magnet 76 closes its magnetic flux through the holding plate 54 retaining the trigger magnet 76 in this position. This position also sets the pin 78 in a position where the pin 78 does not release the latch 64. To initiate a transition from the armed to the working position, in the trigger mechanism 51 an electrical signal is transmitted, such as from the optical speed sensor, through the coil 52 to generate a magnetic field and attract the trigger magnet 76. This attraction pulls the trigger magnet 76 away from the holding plate 54 and towards the first end 68 until the trigger magnet 76 closes its flux through the coil 52. Once in this working position, the trigger magnet 76 remains in this position without a supply of electricity for an indefinite period of time until reset through either mechanical or electrical means.

The movement to the working position also moves the pin 78. As the pin 78 moves, it releases the latch 64, allowing the springs 62 to push the primary magnet 50 from the armed position to the working position. The pin 78 is then held in the working position by the trigger magnet 76, and is reset to its armed position when the trigger magnet 76 returns to its armed position. The primary magnet 50, on the other hand, will remain in the working position through magnetic attraction to the rail 40 until physically disengaged and reset along with the latch 64 and triggering mechanism 51.

Figure 12:
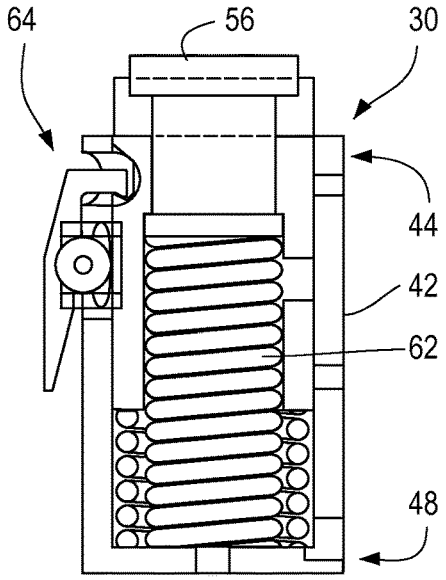
FIG. 12 is a cross-sectional view of the friction force provider built in accordance with an aspect of the present disclosure and detailing a spring force provider without a magnet.

In another embodiment presented in FIG. 12, the FFP 30 may only include the braking pad 54, spring 62, and latch 64. In this embodiment, the latch 64 retains the spring 62 and braking pad 54 in the armed position. Upon activation, the triggering mechanism 51 releases the latch 64 which releases the spring 62 and braking pad 54. This allows the spring to expand and push the braking pad 54 into contact with the rail 40 to create a frictional force in the working position. Once in the working position, the spring 62 and braking pad 54 may be held there indefinitely through the force of the spring 62 without use of electricity, and must be physically reset to be returned to the armed position.

INDUSTRIAL APPLICABILITY

From the foregoing, it can be seen that the technology disclosed herein has industrial applicability in a variety of setting such as, but not limited to, applying a force to an elevator rail to engage an emergency braking system. More specifically, the presented force provider utilizes combinations of permanent magnets, electromagnetic coils, and springs to apply a force to a rail. This force provider has fewer components than prior art force providers and requires a relatively small one-time electrical signal to activate and no electricity to maintain the force provider in both the armed and working positions. A traditional governor is also not needed, eliminating complexity in the elevator system and reducing part count. Further, the proposed friction force provider and triggering mechanism are bi-stable and remain in the armed position and the working position indefinitely without a source of power.

While the present disclosure has been made in reference to an elevator, and specifically to an electrical safety system, one skilled in the art will understand that the teachings herein can be used in other applications as well. For example, the presented teachings may be used to construct a force provider for any application that requires little energy to activate and reset and no energy to maintain in both the armed and working positions. Said force provider can also be implemented where the force provider must be locked in both the armed and working positions. It is therefore intended that the scope of the invention not be limited by the embodiments presented herein as the best mode for carrying out the invention, but that the invention include all equivalents falling within the spirit and scope of the appended claims as well.

What is claimed is:

1. A friction force provider for an emergency safety actuator of an elevator, comprising:

a housing having a first end and an opposing second end, the first end defining an opening; and a primary magnet positioned within the housing and configured to move within the housing between an armed position and a working position, the primary magnet configured to create a force on a rail of an elevator system in the working position extending beyond the housing, and the primary magnet being held within the housing in the armed position, the primary magnet being a permanent magnet;

a holding plate, formed of a magnetically sensitive material, mounted within the housing and an electro-magnetic coil positioned within the housing and associated with the primary magnet;

wherein magnetic flux of the primary magnet is closed through the holding plate in the armed position, to hold the primary magnet within the housing in the armed position without the use of electricity.

2. The friction force provider of claim 1, wherein the electro-magnetic coil is mounted in a stationary position within the housing.

3. The friction force provider of claim 1, wherein the electro-magnetic coil is mounted with the primary magnet such that the electro-magnetic coil moves with the primary magnet.

4. The friction force provider of claim 3, further comprising a secondary magnet positioned within the cavity of the housing and mounted with the primary magnet and electro-magnetic coil such that the secondary magnet moves with same, and wherein the primary magnet and secondary magnet are positioned on opposing ends of the coil.

5. The friction force provider of claim 1, further comprising:

a spring positioned within the housing and biasing the primary magnet towards the first end; and a latch positioned to retain the primary magnet within the housing.

6. The friction force provider of claim 5, wherein the friction force provider is configured to operate with a ropeless elevator.

7. The friction force provider of claim 1, further comprising a guard mounted with the primary magnet such that the guard moves with the primary magnet, the guard having a trapezoidal shaped portion that extends through the opening of the housing while the primary magnet is in the working position.

8. The friction force provider of claim 1, further comprising a braking pad mounted with the primary magnet such that at least in the working position the braking pad extends through the opening of the housing.

9. An elevator system, comprising:

a hoistway;

a car disposed within the hoistway;

a counter weight disposed within the hoistway;

a support structure operatively associated with the car and counter weight;

a rail associated with the car; and an emergency safety actuator operatively associated with the car and rail and having a friction force provider configured to apply a force to the rail;

wherein the emergency safety actuator comprises:

a housing having a first end and an opposing second end, the first end defining an opening;

a primary magnet positioned within the housing and configured to move within the housing between an armed position and a working position, the primary magnet configured to create a force on a rail of an elevator system in the working position extending beyond the housing, and the primary magnet being held within the housing in the armed position, the primary magnet being a permanent magnet;

a holding plate, formed of a magnetically sensitive material, mounted within the housing and an electro-magnetic coil positioned within the housing and associated with the primary magnet;

wherein magnetic flux of the primary magnet is closed through the holding plate in the armed position to hold the primary magnet within the housing in the armed position without the use of electricity.

10. The elevator system of claim 9, wherein the electro-magnetic coil is mounted with the primary magnet such that the electro-magnetic coil moves with the primary magnet.

11. The elevator system of claim 10, wherein the friction force provider further includes a secondary magnet mounted with the primary magnet and electromagnetic coil such that the secondary magnet moves with the both, and positioned such that the primary and secondary magnets are positioned on opposing ends of the electromagnetic coil.

12. The elevator system of claim 9, wherein the electro-magnetic coil is mounted in a stationary position within the housing.

13. The elevator system of claim 9, wherein the triggering mechanism is external to the friction force provider, the friction force provider comprising a housing having a first end and an opposing second end, the first end defining an opening; a spring positioned within the housing at the second end and configured to expand towards the first end; and a latch configured to retain the spring within the housing at the second end, and wherein the triggering mechanism includes:

a trigger housing having a first end and an opposing second end, the first end of the trigger housing defining an opening;

a holding plate mounted within the trigger housing;

an electro-magnetic coil mounted within the trigger housing;

a trigger magnet moveably positioned within the trigger housing, the trigger magnet having an armed position and a working position; and a pin mounted with the trigger magnet such that in the working position the pin moves and releases the latch of the friction force provider.

14. The elevator system of claim 13, wherein the friction force provider further includes a primary magnet positioned within the housing and associated with the spring such that in the working position the primary magnet is directed towards the first end of the housing and the rail.

15. A method of activating a magnetic friction force provider of an emergency safety actuator, comprising:

retaining a primary magnet within a housing of the friction force provider in an armed position, the primary magnet being a permanent magnet;

releasing the primary magnet from the armed position by transmitting an electrical signal through an electro-magnetic coil;

extending the primary magnet from the armed position to a working position; and retaining the primary magnet in the working position;

the method further comprising;

retaining the primary magnet within the housing of the friction force provider in the armed position through a magnetic attraction from the primary magnet to a holding plate, wherein magnetic flux of the primary magnet is closed through the holding plate in the armed position to hold the primary magnet within the housing in the armed position without the use of electricity;

activating the electro-magnetic coil to neutralize the magnetic attraction between the primary magnet and the holding plate to release the primary magnet from the armed position;

extending the primary magnet through an opening of the housing of the friction force provider to the working position through magnetic attraction of the primary magnet to the rail; and retaining the primary magnet in the working position through a magnetic attraction from the primary magnet to the rail.

16. The method of claim 15, further comprising:

retaining the primary magnet within the housing of the friction force provider in the armed position with a latch and biasing the primary magnet towards a working position with a spring;

retaining a trigger magnet in an armed position within a trigger housing of a triggering mechanism by a magnetic attraction from the trigger magnet to the holding plate;

activating the triggering mechanism by transmitting a signal through the electro-magnetic coil to neutralize the magnetic attraction from the trigger magnet to the holding plate;

moving the trigger magnet within a trigger housing of the triggering mechanism through magnetic attraction, and moving the pin with the movement of the tertiary magnet;

releasing the latch with the pin;

extending the primary magnet through an opening in of the trigger housing of the friction force provider with the spring; and retaining the primary magnet in the working position through a magnetic attraction from the primary magnet to the rail.

17. The method of claim 15, further comprising retracting the primary magnet from the working position to the armed position by transmitting a second electrical signal through the electro-magnetic coil.

* * * * *